US007366431B2

(12) United States Patent
Ehara et al.

(10) Patent No.: US 7,366,431 B2
(45) Date of Patent: Apr. 29, 2008

(54) DEVELOPING DEVICE, PROCESS CARTRIDGE AND IMAGE FORMING APPARATUS

(75) Inventors: Yasuhisa Ehara, Kanagawa (JP); Hiroshi Yoshizawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 159 days.

(21) Appl. No.: 11/220,602

(22) Filed: Sep. 8, 2005

(65) Prior Publication Data

US 2006/0056865 A1 Mar. 16, 2006

(30) Foreign Application Priority Data

Sep. 10, 2004 (JP) ..... 2004-263342

(51) Int. Cl.
*G03G 21/18* (2006.01)
*G03G 15/01* (2006.01)
*G03G 15/08* (2006.01)

(52) U.S. Cl. ..... 399/27; 399/12; 399/119; 399/258

(58) Field of Classification Search ..... 399/12, 399/27, 28, 110, 111, 112, 119, 120, 223, 399/258; 347/138, 152, 19, 49, 86
See application file for complete search history.

(56) References Cited

U.S. PATENT DOCUMENTS 4,963,939 A * 10/1990 Kurando et al. ..... 399/12
5,923,918 A * 7/1999 Nakagawa et al. ..... 399/27
6,608,981 B2 * 8/2003 Mae ..... 399/116
6,959,156 B2 * 10/2005 Ogata ..... 399/27
6,978,102 B2 * 12/2005 Okamura et al. ..... 399/110
2003/0073021 A1 * 4/2003 Sasaki et al. ..... 430/110.4
2004/0120723 A1 * 6/2004 Ito ..... 399/12
2005/0063713 A1 3/2005 Watanabe et al. ..... 399/12
2005/0095017 A1 5/2005 Kikuchi ..... 399/12
2005/0111858 A1 5/2005 Nakazato ..... 399/12
2005/0265751 A1 * 12/2005 Nakazato et al. ..... 399/259

FOREIGN PATENT DOCUMENTS

JP 01-049066 A * 2/1989
JP 6-258911 9/1994
JP 8-146744 6/1996
JP 3061806 B2 4/2000
JP 2005-055834 A * 3/2005

* cited by examiner

*Primary Examiner*—Sophia S. Chen
(74) *Attorney, Agent, or Firm*—Oblon, Spivak, McClelland, Maier & Neustadt, P.C.

(57) ABSTRACT

In accordance with the present invention, a transparent or semitransparent window is formed in a developing device or a process cartridge to allow one to see the inside of the developing device via the window from the outside. The window may preferably be formed in the top wall of the developing unit or that of the process cartridge.

18 Claims, 12 Drawing Sheets

DEVELOPING DEVICE, PROCESS CARTRIDGE AND IMAGE FORMING APPARATUS

BACKGROUND OF THE INVENTION

1. Field of the Invention

The present invention relates to a printer, facsimile apparatus, multifunction machine or similar image forming apparatus and more particularly to an electrophotographic image forming apparatus configured to directly or indirectly transfer a toner image formed on an image carrier to a sheet, OHP (OverHead Projector) film or similar recording medium. Further, the present invention relates to a process cartridge removably mounted on an electrophotographic image forming apparatus and including at least a developing device and any one of an image carrier, a charger, an image transferring device and a cleaning device.

2. Description of the Background Art

It is a common practice with an electrophotographic image forming apparatus to uniformly charge the surface of a photoconductive drum, photoconductive belt or similar image carrier, which is in rotation, with a charger, expose the charged surface of the image carrier with an optical writing device to thereby form a latent image, deposit toner on the latent image to thereby form a corresponding toner image, and directly or indirectly transfer the toner image to a recording medium with an image transferring device.

Conventional electrophotographic image forming apparatuses include one on which a process cartridge, accommodating some of an image carrier, a charger, a developing device, a cleaning device and other process units, is removably mounted. The process cartridge not only enhances easy, efficient maintenance, but also reduces the overall size of the image forming apparatus.

Today, a tandem, image forming apparatus, for example, is extensively used for producing color images and includes four stations assigned to a respective color each, e.g., a black, a yellow, a cyan and a magenta station. Each of the four stations includes a respective developing device or a respective process cartridge storing a developer of a particular color. In operation, latent images formed on image carriers are developed by toners of different colors of the developing devices or the process cartridges, and the resulting toner images are sequentially transferred to a recording medium one above the other to thereby form a composite full-color image.

A developer is consumed by repeated development and therefore needs replenishment. It has been customary with an image forming apparatus to replenish fresh toner of a particular color to each of the developing devices or the process cartridges or bodily replace each developing device or each process cartridge when the developing device or the process cartridge has run out of toner. However, the replacement of the process cartridges is not practicable unless the user of the image forming apparatus prepares spare developing devices or process cartridges assigned to a respective color each. This forces the user to prepare an exclusive place for storing, e.g., four spare developing devices or process cartridges of different colors beforehand and therefore causes the user to bear a heavy burden.

Moreover, preparing developing devices or process cartridges of different kinds increases the number of parts and therefore requires classification or production adjustment part by part, causing a manufacturer to bear a heavy burden, too, in the aspect of the management of production and parts.

In light of the above, there has been proposed an image forming apparatus of the type using identical developing devices or identical process cartridges. In this case, only carrier grains, forming part of a two-ingredient type developer, are stored in all developing devices beforehand. Such identical developing devices or process cartridges each are mounted to the body of a particular station of a single image forming apparatus or the body of a particular image forming apparatus. Thereafter, toner grains of a particular color are replenished to the respective developing device or process cartridge. However, the problem with this scheme is that when a person dismounts the developing devices or the toner cartridges, each storing the toner grains of the respective color, for a maintenance or similar purpose and again mounts them, the operator is likely to confuse the stations of a single image forming apparatus or the bodies of image forming apparatuses, resulting in the mixture of colors or development in wrong colors and therefore defective images.

Technologies relating to the present invention are disclosed in, e.g., Japanese Patent Laid-Open Publication No. 6-258911, 2000-181176 and 8-146744.

SUMMARY OF THE INVENTION

It is an object of the present invention to prevent, in a developing device of the type storing carrier grains, which form part of a two-ingredient type developer, beforehand and replenished with toner grains after being removably mounted to the body of an image forming apparatus in order to perform development, a process cartridge including such a developing device or an image forming apparatus including such a developing device or a process cartridge, the developing device or the process cartridge from being mounted to a wrong station.

In accordance with the present invention, in a developing device storing only carrier grains, which form part of a two-ingredient type developer, beforehand and replenished with toner grains, which form the other part of the developer, after being removably mounted to the body of an image forming apparatus for developing a latent image formed on an image carrier with the toner to thereby produce a corresponding toner image, a window is formed in a portion of the developing device that allows one to see the inside of the developing device from the outside.

An image forming apparatus including the above developing device and a process cartridge including at least the developing device are also disclosed.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
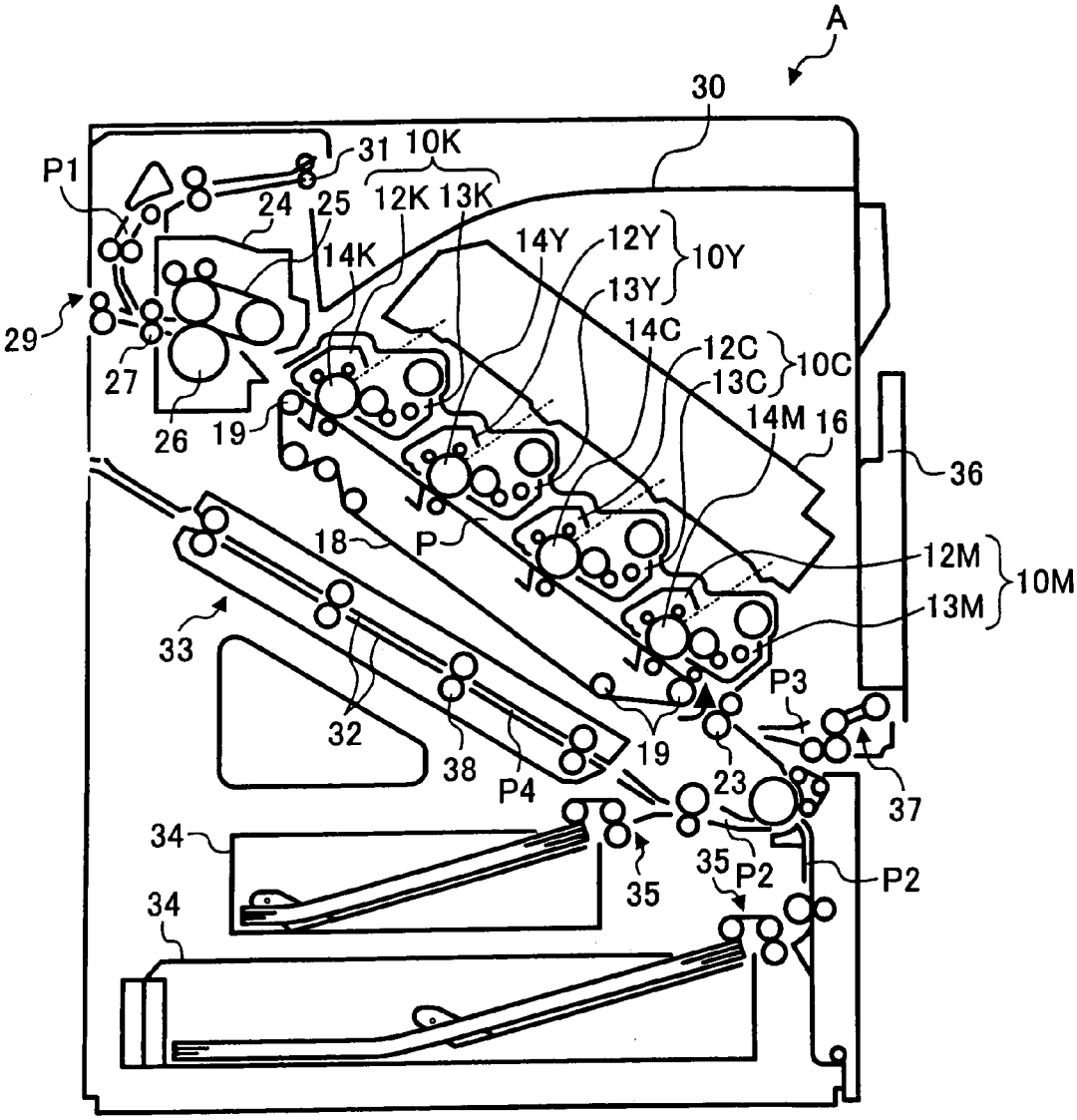
FIG. 1 is a view showing the general construction of an image forming apparatus embodying the present invention and implemented as a tandem color image forming apparatus by way of example.
Figure 2:
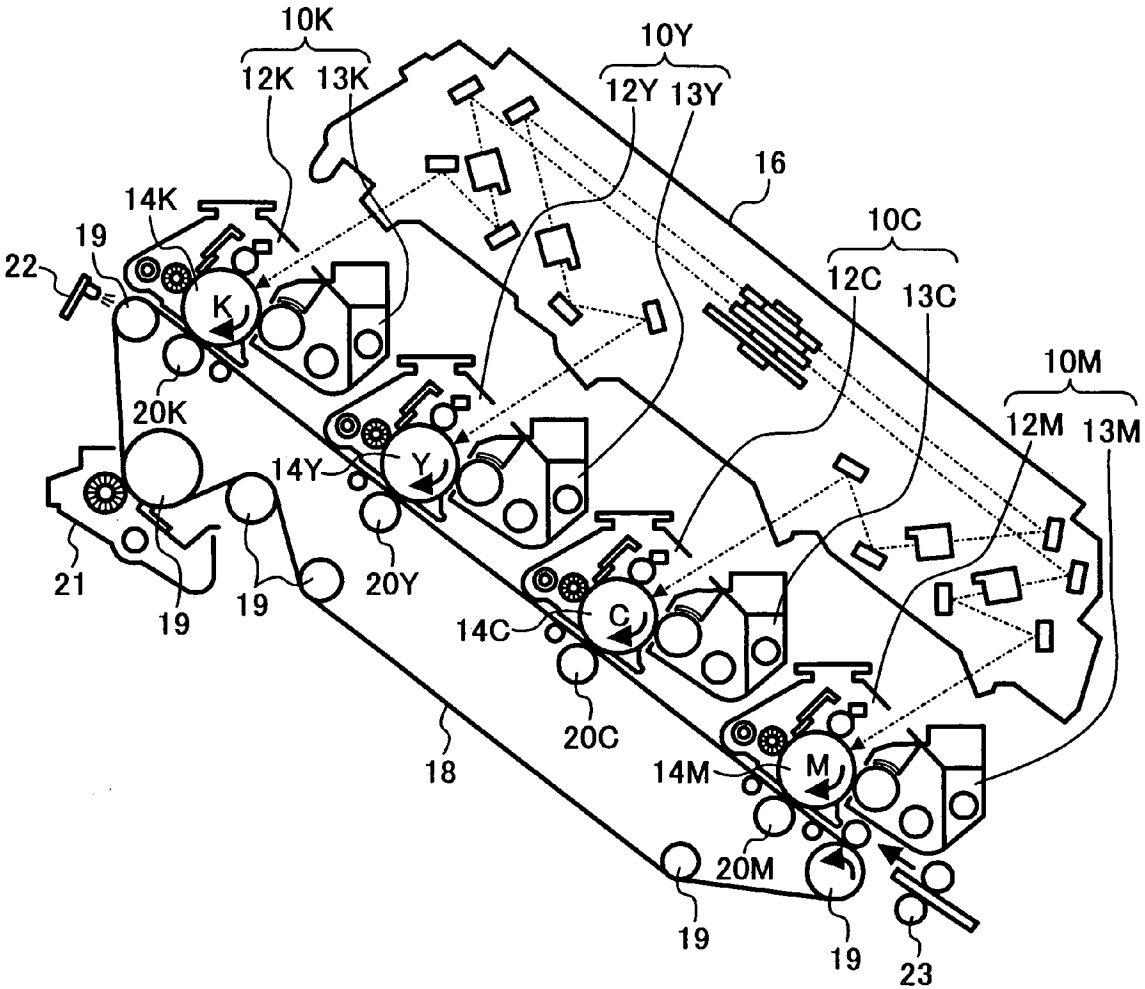
FIG. 2 is a fragmentary enlarged view showing arrangements in and around an image forming device included in the illustrative embodiment.

Referring to FIG. 1 of the drawings, an image forming apparatus embodying the present invention is shown and provided with a tandem arrangement including a magenta, a cyan, a yellow and a black station. FIG. 2 is a fragmentary enlarged view showing an image forming device arranged in the image forming apparatus. As shown, the image forming apparatus includes a body, generally labeled A, in which a sheet path or recording medium path P obliquely extends from the bottom right portion toward the top left portion. The sheet path P has an automatic sheet feed path P2 and a manual sheet feed path P3 at the inlet side and has a sheet turn path P1 at the outlet side.

The image forming device is arranged on the inclined sheet path P and includes four stations disposed side by side along the sheet path P. A magenta, a cyan, a yellow and a black process cartridge 10M, 10C, 10Y and 10K, respectively, are positioned at the respective stations in a tandem configuration. The magenta process cartridge 10 is generally made up of a drum unit or image carrier unit 12M and a developing unit or developing device 13M and removably mounted to the apparatus body A. Likewise, the cyan, yellow and black process cartridges 10C, 10Y and 10K are respectively made up of drum units 12C, 12Y and 12K and developing units 13C, 13Y and 13K and also removably mounted to the apparatus body A. The drum units 12M, 12C, 12Y and 12K include photoconductive drums or image carriers (simply drums hereinafter) 14M, 14C, 14Y and 14K, respectively.

A conventional optical writing unit 16 is obliquely positioned above and shared by the four process cartridges 10M through 10K.

An endless belt or sheet support 18 extends below the process cartridges 10M through 10K with the intermediary of the sheet path P and is passed over a plurality of rollers 19. The belt 18 is held in contact with the drums 14M through 14K and partly positioned obliquely flat along the sheet path P. A drive source, not shown, causes the belt 18 to turn counterclockwise, as indicated by an arrow in FIG. 1. Image transfer rollers or image transferring devices 20M, 20C, 20Y and 20K are positioned inside of the loop of the belt 18 and face the drums 14M, 14C, 14Y and 14K, respectively, with the intermediary of the upper run of the belt 18. The image transfer rollers 20M through 20K may, of course, be replaced with non-contact type chargers, if desired. A cleaning unit 21 and a so-called P sensor 22 responsive to an image density are positioned outside of the loop of the belt 18, as illustrated.

A registration roller pair 23 and a fixing unit 24 are respectively positioned upstream and downstream of the belt 18 in the direction of the sheet path P. The fixing unit 24 has a conventional configuration including an endless fixing belt 25, a press roller 26 pressed against the fixing belt 25 and an outlet roller pair 27.

A sheet outlet 29 is formed in the left sidewall of the apparatus body A, as viewed in FIG. 1, downstream of the fixing unit 24. The sheet turn path P branches off the sheet path P and terminates at a stacking surface 30 formed on the top of the apparatus body A. An outlet roller pair 31 is operated to discharge a sheet to the stacking surface 30.

A sheet refeeding unit 33 is obliquely positioned below the belt 18 and includes a sheet refeed path P4 formed by a pair of guide plates 32 facing each other and a plurality of roller pairs 38. Two sheet cassettes 34 are positioned below the sheet refeeding unit 33 one above the other, and each is loaded with a stack of sheets of a particular size. Sheet feeding devices 35, each including a pickup roller and a reverse roller, each are associated with one of the sheet cassettes 34 for feeding the above sheets one by one. The automatic sheet feed path P2 mentioned earlier is arranged at the right-hand side of the sheet feeding devices 35, as viewed in FIG. 1. The automatic sheet feed path P2 extends from the sheet feeding devices 35 and sheet refeeding unit 33 to the registration roller pair 23 located on the sheet path P.

A manual sheet feeding device, including a manual sheet feed tray 36, is mounted on the right sidewall of the apparatus body, as viewed in FIG. 1. The manual sheet feed tray 36 is hinged to the apparatus body A in such a manner as to be openable from the position shown in FIG. 1, although not shown specifically. A sheet feeding device 37 is included in the manual sheet feeding device for feeding sheets stacked on the manual sheet feed tray 36 one by one. The manual sheet feed path P3 mentioned earlier extends from the sheet feeding device 37 to the registration roller pair 23 positioned on the sheet path P.

In operation, one of the sheet feeding devices 35 is operated in response to a signal received from, e.g., a host and pays out the top sheet from the sheet cassette 34 associated therewith while separating the top sheet from the underlying sheets. The sheet thus paid out is conveyed to the registration roller pair 23 via the automatic sheet feed path P2 and once stopped thereby. Alternatively, the manual sheet feeding device 37 may be driven to pay out the top sheet from the manual sheet feed tray 36 and feed it toward the registration roller pair 23 via the manual sheet feed path P3. This sheet is also stopped by the registration roller pair 23.

On the other hand, the drums 14M through 14K included in the process cartridges 10M through 10K, respectively, are rotated to form a magenta, a cyan, a yellow and a black toner image thereon, respectively. Further, a drive motor, not shown, causes one of the support rollers 19 to rotate at preselected timing for thereby turning the belt 18. At this instant, the other support rollers 19 are caused to rotate via the belt 18.

The registration roller pair 23 is caused to start rotating in synchronism with the rotation of the drums 14M through 14K, conveying the sheet toward a nip between the drum 14M and the belt 18. Subsequently, the belt 18 conveys the sheet via the nips between the consecutive drums 14M through 14K and the belt 18 itself, so that the toner images formed on the drums 14M through 14K are sequentially transferred to the sheet by the image transfer rollers 20M through 20K. As a result, a composite full-color image is formed on the sheet.

The sheet, carrying the full-color image thereon, is conveyed to the fixing unit 24 so as to have the toner image fixed thereon and is then driven out of the fixing unit 24 by the outlet roller pair 27. In a face-up mode available with the illustrative embodiment, the sheet or print thus driven out of the fixing unit 24 is conveyed via the sheet path P straight to the outside of the apparatus body A via the sheet outlet 29 and then stacked on a print tray, not shown, face up or introduced into, e.g., a finisher, a sorter or a duplex printing device. On the other hand, in a face-down mode also available with the illustrative embodiment, the sheet is steered into the sheet turn path P1 by a path selector, not shown, and then discharged by the outlet roller pair 31 to the stacking surface 30 face down. Therefore, in the face-down mode, consecutive sheets or prints are stacked on the stacking surface 30 in order of page.

The process cartridges 10M through 10K removably mounted on the apparatus body A will be described with reference to FIG. 3 hereinafter. Because the process cartridges 10M through 10K are identical in configuration, let the following description concentrate on only one of them. It is to be noted that the suffixes M, C, Y and K, distinguishing the process cartridges and structural parts thereof, are not shown in FIG. 3. As shown, the process cartridge 10 includes a charger 40 and a drum cleaner or cleaning device 41 arranged around the drum or image carrier 14.

The charger 40 is implemented as a charge roller or charging member 42 adjoining the drum 14 and configured to uniformly charge the surface of the drum 14 when applied with a charge bias. A cleaner 43 is held in contact with the surface of the charge roller 42 for cleaning the surface of the charge roller 42. The charge roller 42 may, of course, be replaced with a conventional non-contact type charger, if desired.

The drum cleaner 41 includes a fur brush 44, a cleaning blade 45 and a screw 46. The fur brush 44 is rotatable in contact with the surface of the drum 14 while the cleaning blade 45 has an edge pressed against the surface of the drum 14. More specifically, the fur brush 44 is rotated counter in direction to the drum 14 in order to remove toner left on the drum 14 after image transfer. Thereafter, the cleaning blade 45 scrapes off toner still remaining on the drum 14. In the illustrative embodiment, the toner thus removed from the drum 14 by the fur brush 44 and cleaning blade 45 is conveyed to a waste toner bottle, not shown, shared by the four colors of toner by the screw 46.

The developing unit 13, also included in the process cartridge 10, uses a two-ingredient type developer made up of magnetic carrier grains and nonmagnetic toner grains, which is magenta, cyan, yellow or black. In the illustrative embodiment, only carrier grains are stored in the developing unit 13 before the process cartridge 10 is mounted to the apparatus body A. After the process cartridge 10 has been mounted to the apparatus body A, toner grains are replenished from a toner cartridge 47 to the developing unit 13. In this manner, after four process cartridges 10M through 10K have been mounted to the apparatus body A, toner grains of a particular color is replenished to the developing unit 13 of the process cartridge.

More specifically, the developing unit 13 includes two screws 48, a developing roller 49, a doctor blade 50 and a toner content sensor 51. The screws 48 convey the carrier grains and toner grains replenished from the toner cartridge 47, i.e., a two-ingredient type developer toward the developing roller 49 while agitating them. The developing roller 49 plays the role of a developer carrier on which the above developer is deposited. The doctor blade 50 serves as a metering member for causing the developer deposited on the developing roller 49 to form a thin layer.

Figure 3:
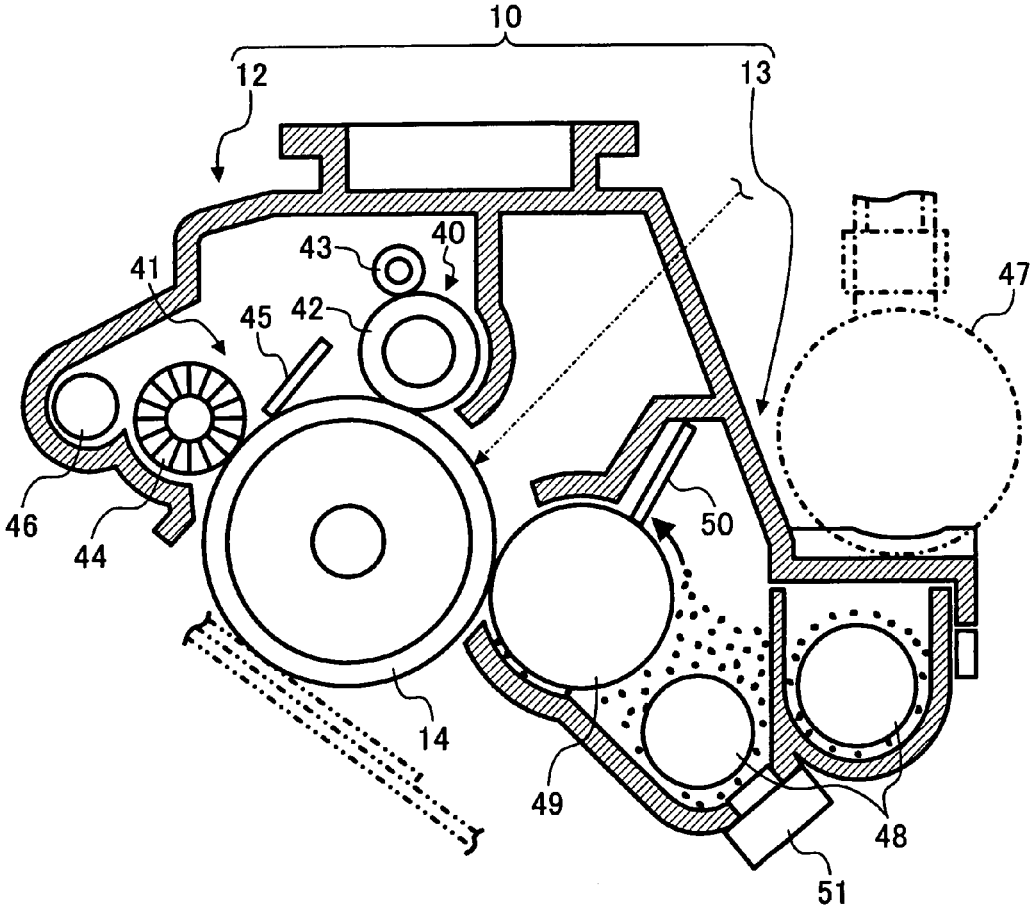
FIG. 3 is a fragmentary section showing a specific configuration of one of four process cartridges included in the image forming device.

In operation, in the process cartridge 10 while the image carrier 14 is rotated clockwise, as seen in FIG. 3, the charger 40 uniformly charges the surface of the drum 14. Subsequently, the optical writing unit 16, FIG. 1, scans the charged surface of the drum 14 with a light beam for thereby forming a latent image on the drum 14. Thereafter, the toner deposited on the developing roller 49 of the developing unit 13 is transferred to the drum 14 to thereby produce a corresponding toner image on the drum 14. Such a procedure is executed by each of the four process cartridges 10M through 10K with the result that a magenta, a cyan, a yellow and a black toner image are formed on the drums 14M, 14C, 14Y and 14K, respectively.

In the illustrative embodiment, the charger 40, developing unit 13 and drum cleaner 41 are integrally arranged in the process cartridge 10 together with the drum 14 and therefore removable from the apparatus body A together. This successfully enhances easy, efficient maintenance and contributes to the size reduction of the apparatus body A. However, the prerequisite with the present invention is that the developing unit 13 and at least one of the drum 14, charger 40 and drum cleaner 41 be accommodated in the process cartridge 10. Stated another way, not all of the charger 40, developing unit 13 and drum cleaner 41 have to be arranged in the process cartridge 10.

Figure 4:
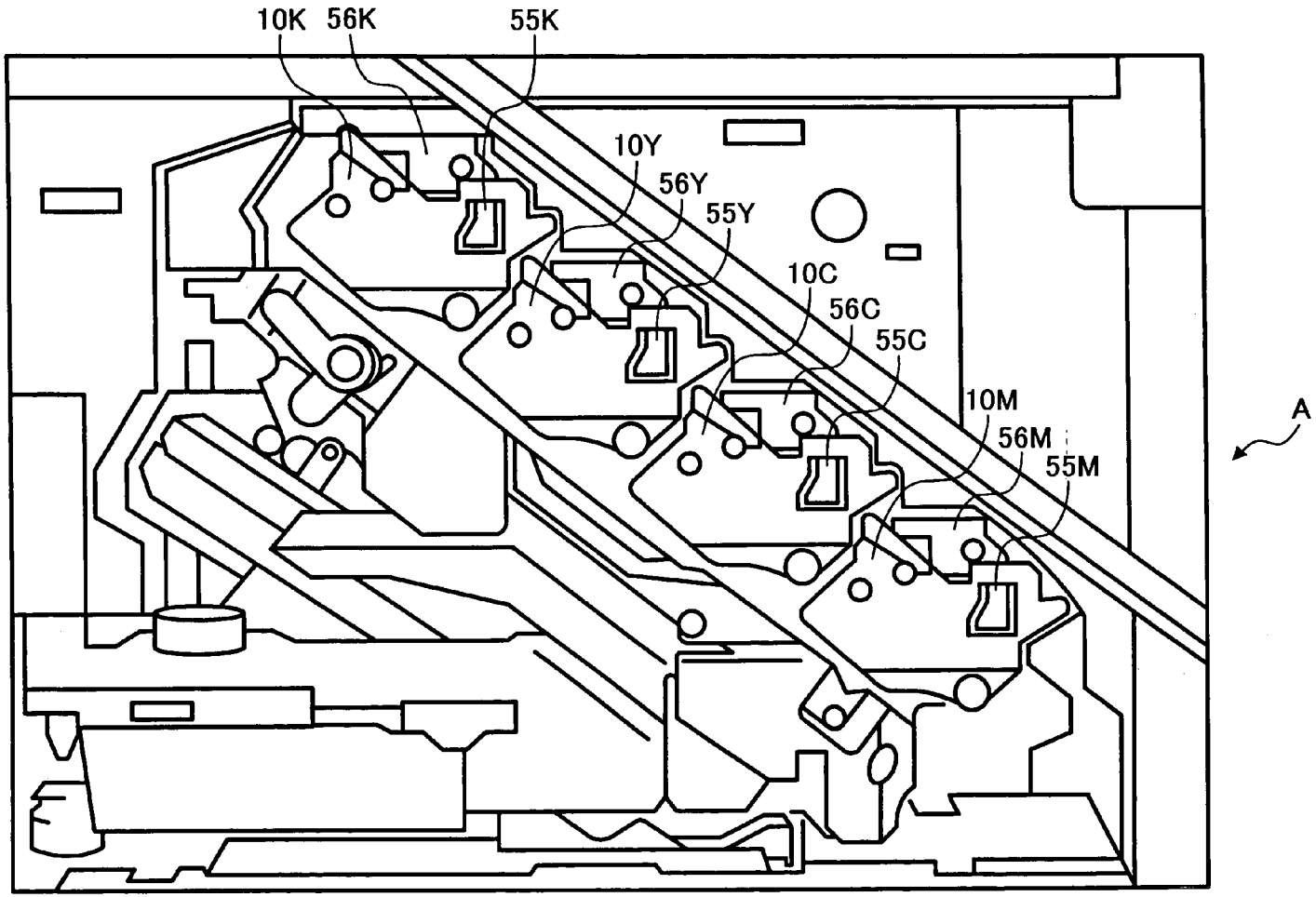
FIG. 4 is a front view showing the body of the image forming apparatus whose front cover is held in an open position.
Figure 5:
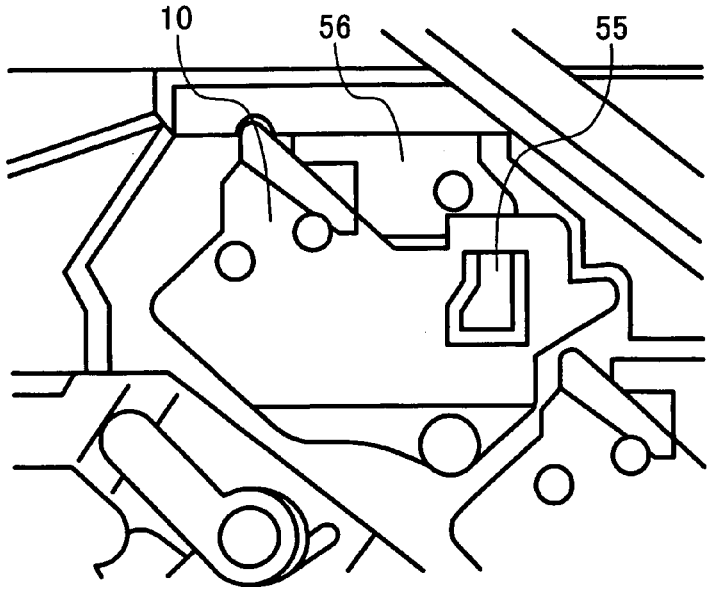
FIG. 5 is a fragmentary enlarged view showing one of the process cartridges in the condition of FIG. 4.

FIG. 4 shows the apparatus body A with its front cover, not shown, being opened while FIG. 5 shows one process cartridge 10 in the condition shown in FIG. 4 in an enlarged view. In FIG. 4, the process cartridges 10M through 10K are removably mounted to the apparatus body A from the front, as seen in the direction perpendicular to the sheet surface of FIG. 4.

Figure 6:
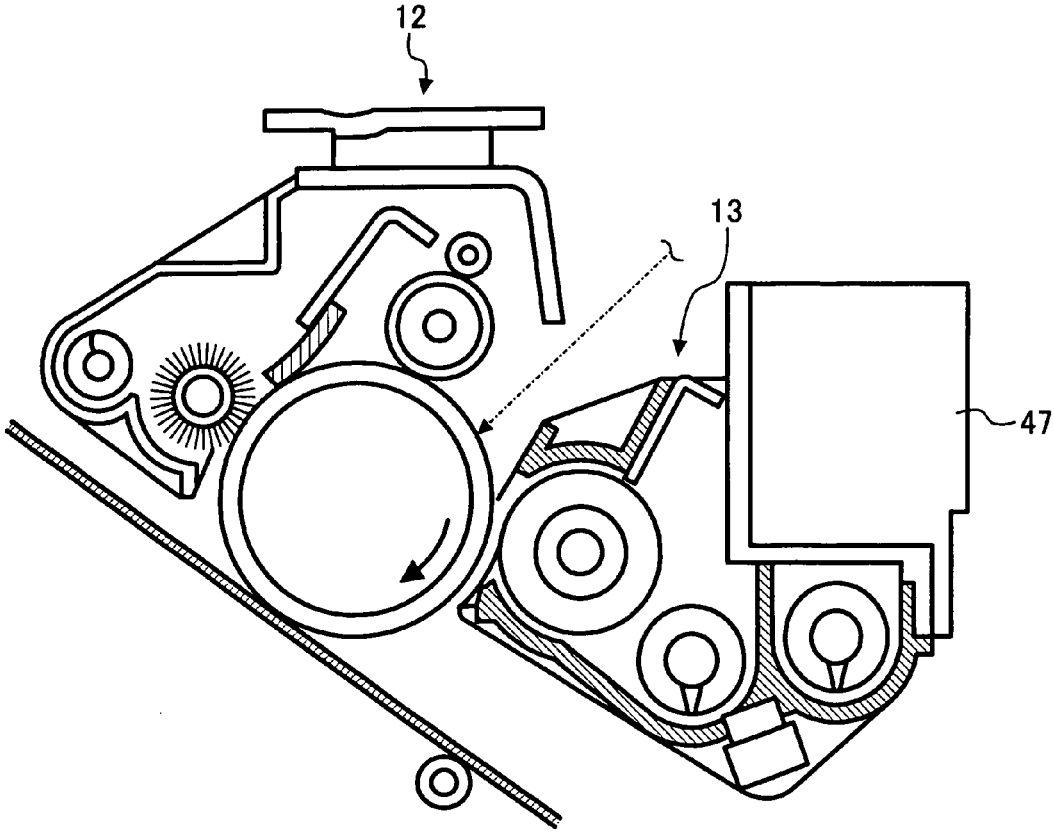
FIG. 6 is a fragmentary section showing a modification of the illustrative embodiment.
Figure 7:
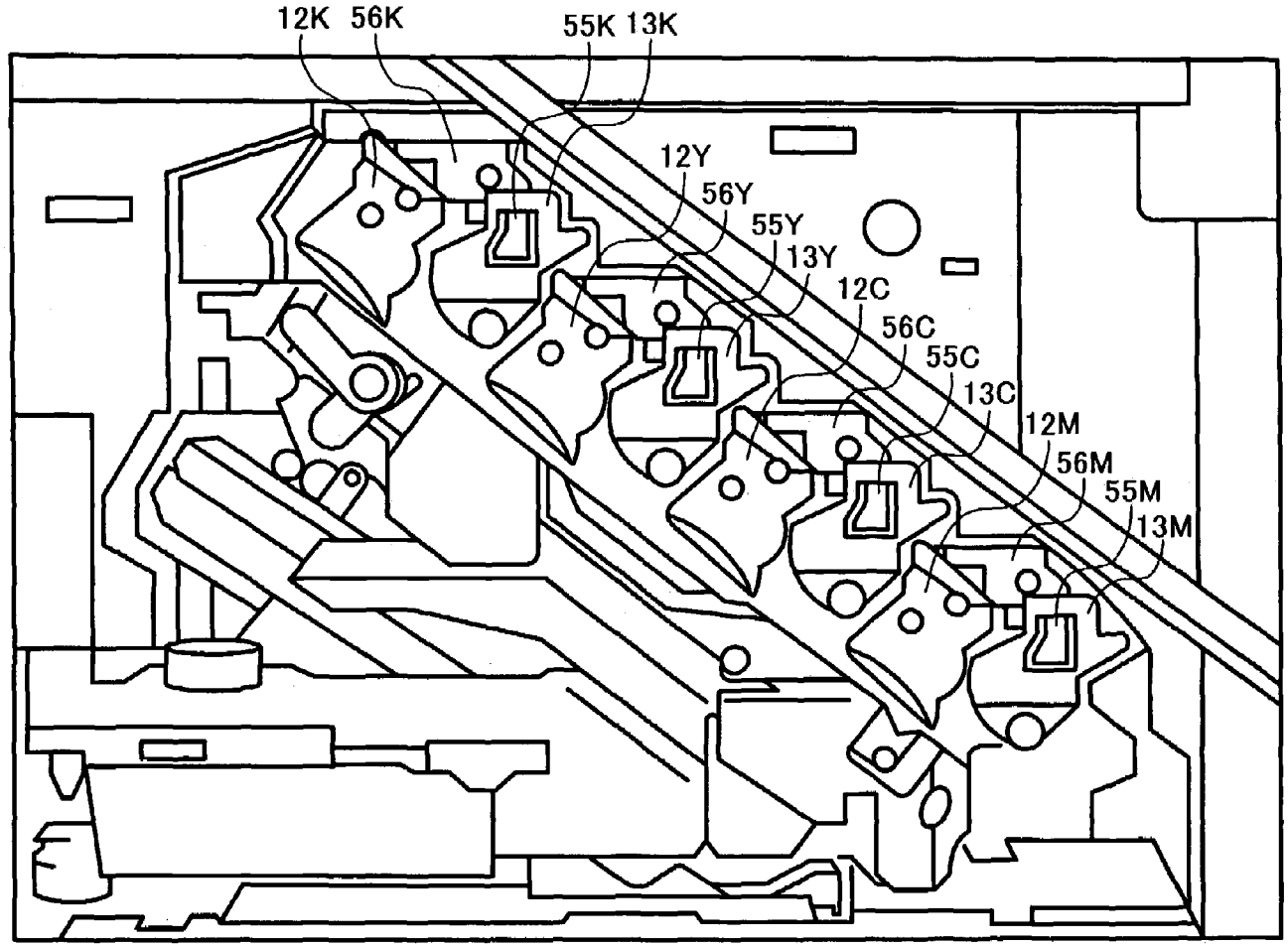
FIG. 7 is a view corresponding to FIG. 4, showing the apparatus body including the modification of FIG. 6.
Figure 8:
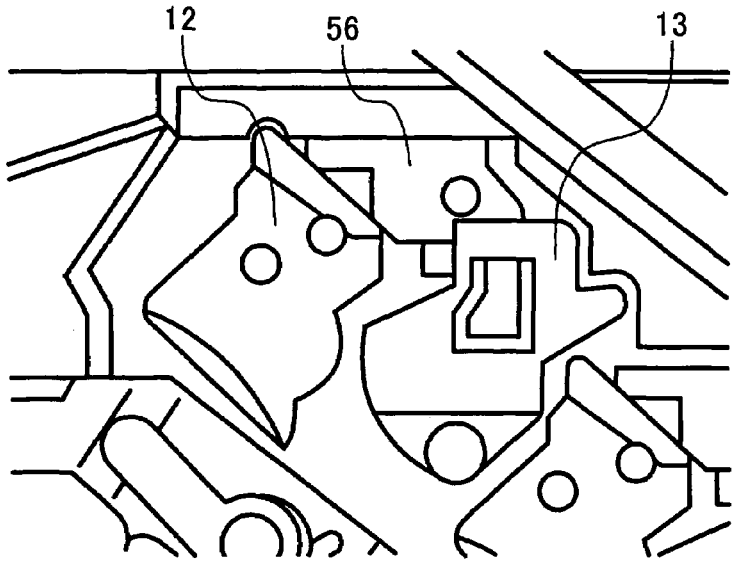
FIG. 8 is a fragmentary enlarged view showing one of four stations in the condition of FIG. 7.

In the illustrative embodiment, the drum unit 12 and developing unit 13 are constructed into a single process cartridge 10, as stated above. FIG. 6 shows a modification of the illustrative embodiment. As shown, in the modification, the drum unit 12 and developing unit 13 are implemented as separate units positioned relative to each other as shown in FIG. 7 when the front cover of the apparatus body A is opened. The drum unit 12 and developing unit 13, like the process cartridge 10, are mounted to the apparatus body A from the front, as seen in the direction perpendicular to the sheet surface of FIG. 7, independently of each other. FIG. 8 is an enlarged view showing the combination of the drum unit 12 and developing unit 13 in a condition wherein the front cover of the apparatus body A is opened.

In the above modification, only carrier grains, forming part of a two-ingredient type developer, are stored in the developing unit 13 before the developing unit 13 is mounted to the apparatus body A. After the developing unit 13 has been mounted to the apparatus body A, toner grains are replenished from the toner cartridge 47, FIG. 6, to the developing unit 13. In this manner, after four developing units 13 have been mounted to the apparatus body A, toner grains of a particular color are replenished to the developing unit 13 of each process cartridge.

Figure 9:
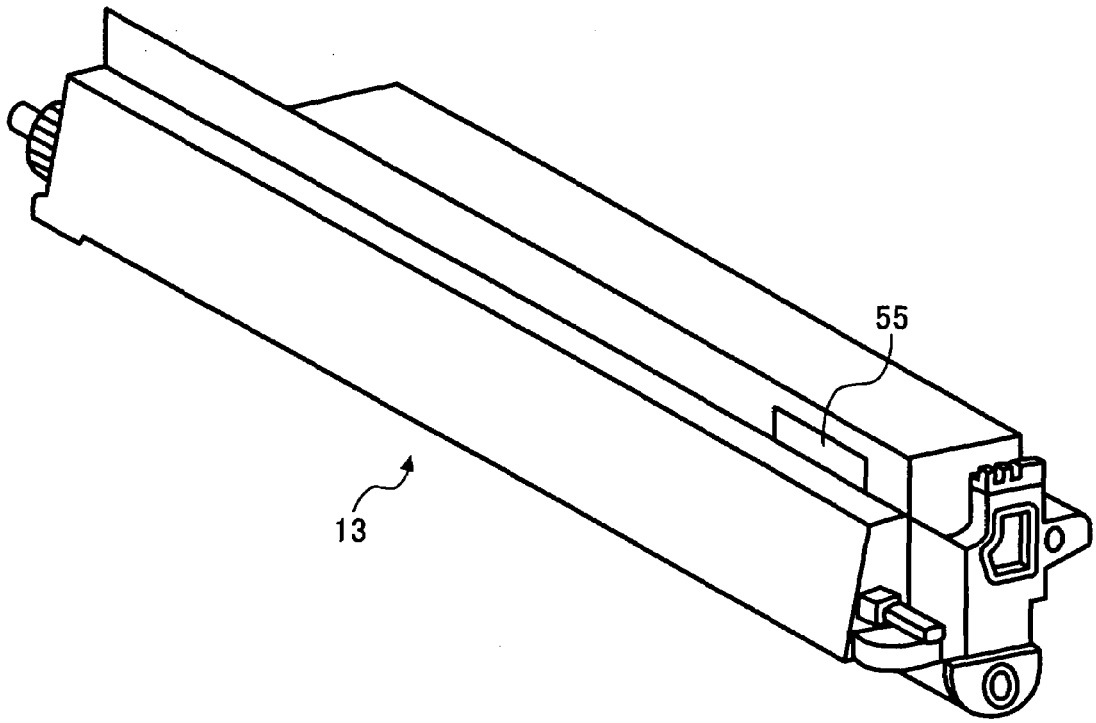
FIG. 9 is an isometric view showing a specific configuration of a developing unit included in the modification.
Figure 10:
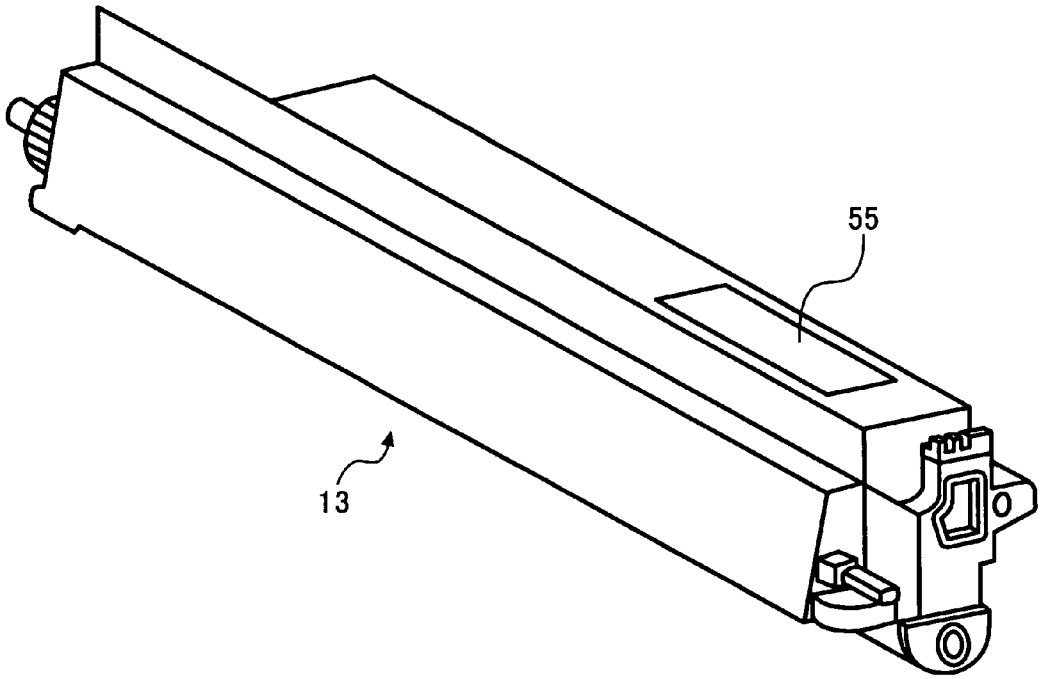
FIG. 10 is an isometric view showing another specific configuration of the developing unit included in the modification.

As shown in FIG. 9 specifically, each developing unit 13 is formed with a respective window 55 (55K, 55Y, 55C, and 55M for window on the black, yellow, cyan, and magenta developing units 13K, 13Y, 13C, and 13M, respectively) that allows a person to see the inside of the developing unit 13. The window 55 is closed by a transparent or a semitransparent member for preventing the developer from leaking to the outside. As shown in FIG. 10 specifically, the window 55 may be formed in the upper wall of the developing unit 13, so that one can easily see the inside of the developing unit 13.

With the configuration stated above, the modification makes it possible to for one to easily see the inside of the developing unit 13, i.e., to determine whether or not fresh toner is present in the developing unit 13 via the window 55 without resorting to sophisticated, expensive means. In addition, by confirming the color or kind of toner stored in the developing unit 13 via the window 55 before mounting it to the apparatus body A, one is prevented from mounting the developing unit 13 to a wrong station of the apparatus body A.

Further, as shown in FIGS. 7 and 8, labels or similar color display members 56M, 56C, 56Y and 56K are adhered, fastened or otherwise provided on the respective stations of the apparatus body A in the vicinity of positions assigned to the developing units. The color display members 56 may be respectively painted magenta, cyan, yellow and black or provided with symbols, e.g., letters "RED", "BLUE", "YELLOW" and "BLACK" or "M", "C", "Y" and "K". This allows one to compare the color of toner stored in each developing unit 13 with the colors of the color display members 56, thereby more surely preventing the developing unit 13 from being mounted to a wrong station.

Figure 11:
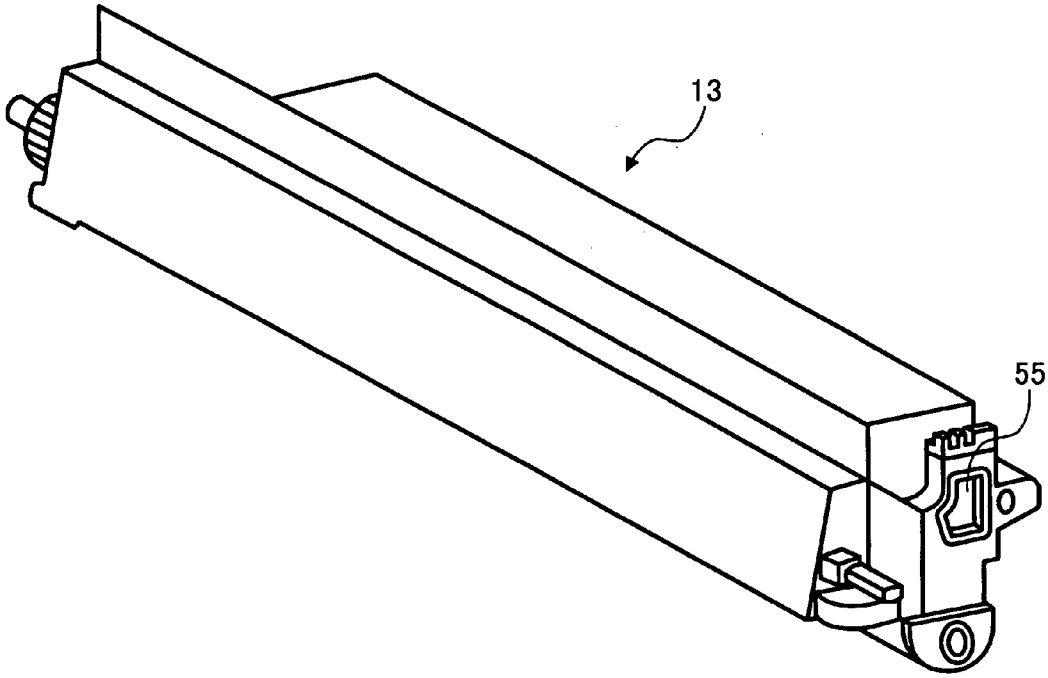
FIG. 11 is an isometric view showing still another specific configuration of the developing unit included in the modification.

As shown in FIG. 11, the window 55 may be formed in the front end of the developing unit 13, so that one can see the inside of the developing unit 13 set on the apparatus body A when the front cover of the apparatus body A is opened, as shown in FIG. 7. Such a window 55 allows one to easily see the inside of the developing unit 13 without removing the developing unit 13 from the apparatus body A and therefore insures the detection of incorrect mounting.

As stated above, in the modification of the illustrative embodiment, the window 55 is formed in the developing unit or developing device 13 that stores only carrier grains beforehand and is removably mounted to the apparatus body A. Alternatively, the window 55 may be formed in the process cartridge 10 including at least the developing unit 13 loaded with only carrier grains beforehand and removably mounted to the apparatus body A. In this case, too, the window 55 will be so positioned as to allow one to easily see the inside of the developing unit 13. Also, as shown in FIGS. 5 and 6, the color display members 56M through 56K may be located around the positions of the apparatus body A assigned to the process cartridges 10M through 10K. In addition, the window 55 of each process cartridge 10 may be so positioned as to allow one to see the inside of the developing unit 13 without removing the process cartridge 10 from the apparatus body A.

In the illustrative embodiment and its modification described above, a plurality of developing units 13 or a plurality of process cartridges 10 are mounted to the apparatus body A, and each is replenished with toner of a particular color. The present invention is similarly applicable to a single developing device or a single process cartridge to be removably mounted to the body of an image forming apparatus in order to obviate confusion of different types of image forming apparatuses, as will be described hereinafter.

Figure 12:
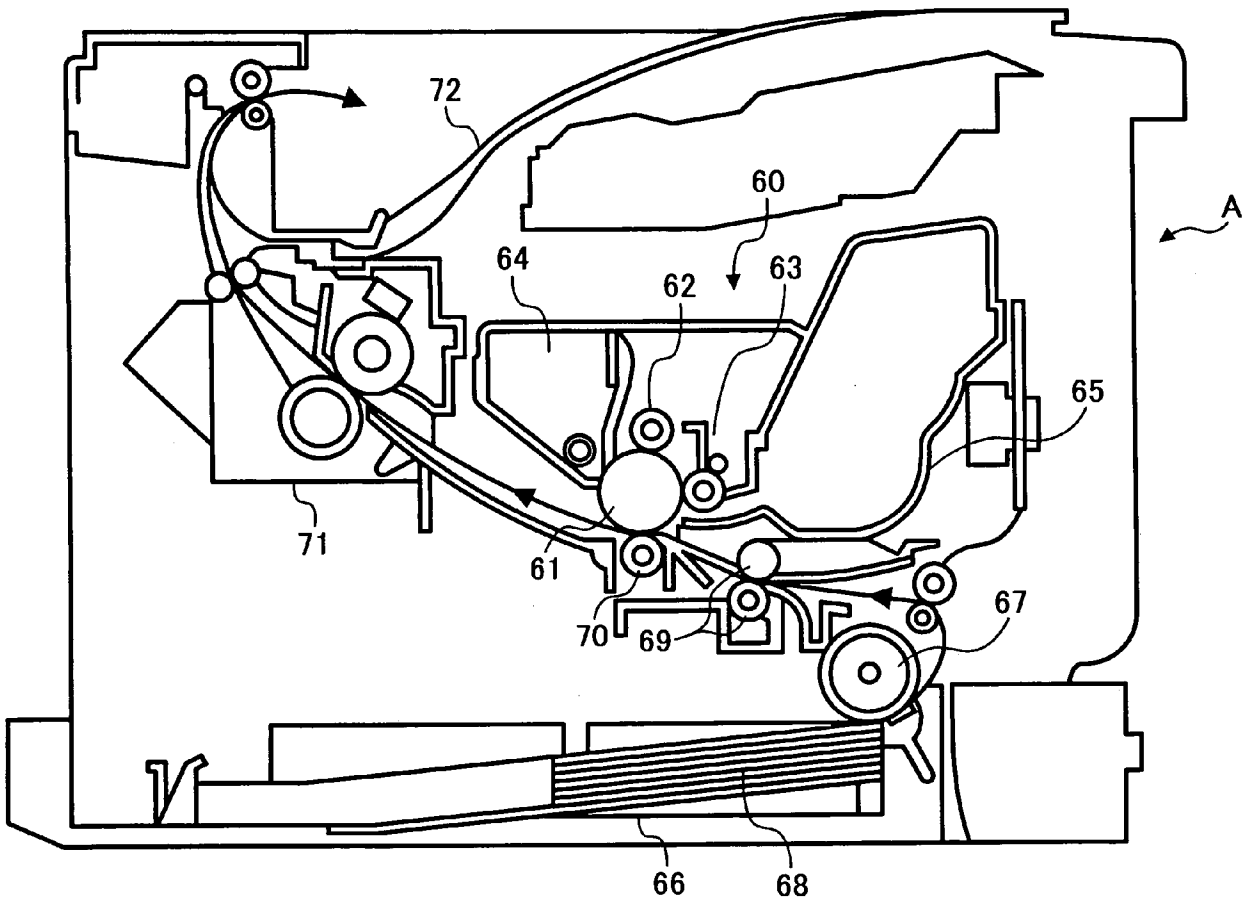
FIG. 12 is a view showing an alternative embodiment of the present invention implemented as a printer including a single process cartridge.

Reference will be made to FIG. 12 for describing an alternative embodiment of the image forming apparatus in accordance with the present invention implemented as a printer by way of example. As shown, a process cartridge 60 is removably mounted on the printer and includes a casing 65 that accommodates a photoconductive drum or image carrier 61, a charger 62, a developing device 63 and a drum cleaner or cleaning device 64. A window, not shown, is formed in the cartridge casing 65 to allow one to see the inside of the developing device 63 from the outside. After the developing device 63, storing only carrier grains that form part of a two-ingredient type developer beforehand, has been mounted to the apparatus body A, toner grains are replenished to the developing device 63.

In operation, a toner image is formed on the drum 61 being rotated. On the other hand, a sheet 68 is paid out from a sheet cassette 66 by a pickup roller 67 and conveyed toward a registration roller pair 69. The registration roller pair 69 once stops the sheet 68 and again drives it to a nip between the drum 61 and an image transferring device 70 at preselected timing. At the above nip, the image transferring device 70 transfers the toner image from the drum 61 to the sheet 68. The sheet 68, thus carrying the toner image thereon, has the toner image fixed by a fixing unit 71 and is then driven out of the printer body to a stacking surface 72 formed on the top of the printer as a print.

Figure 13:
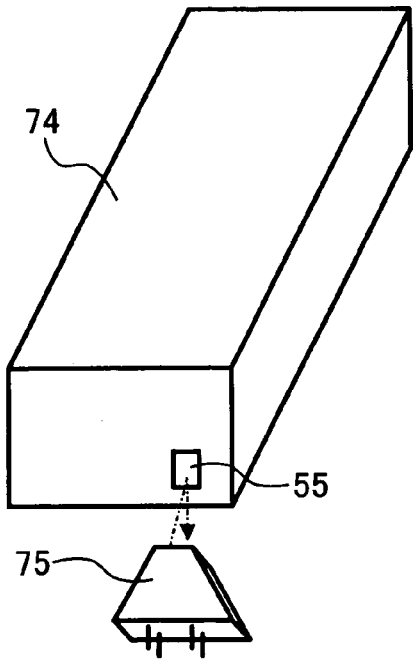
FIG. 13 is an isometric view showing a single sensing means for sensing the color of toner.

If desired, sensing means for sensing the color of toner replenished to the developing device via the window 55 may be mounted on the developing device or the process cartridge. A specific configuration including such sensing means is shown in FIG. 13. As shown, sensing means 75 is so positioned as to sense the color of toner stored in the developing device or the process cartridge, labeled 74, via the window 55. The sensing means 75 is implemented by a reflection type sensor. Whether or not the color of toner sensed by the sensing means 75 is identical with, e.g., the color of the color display member 56 stated previously is determined.

Figure 14:
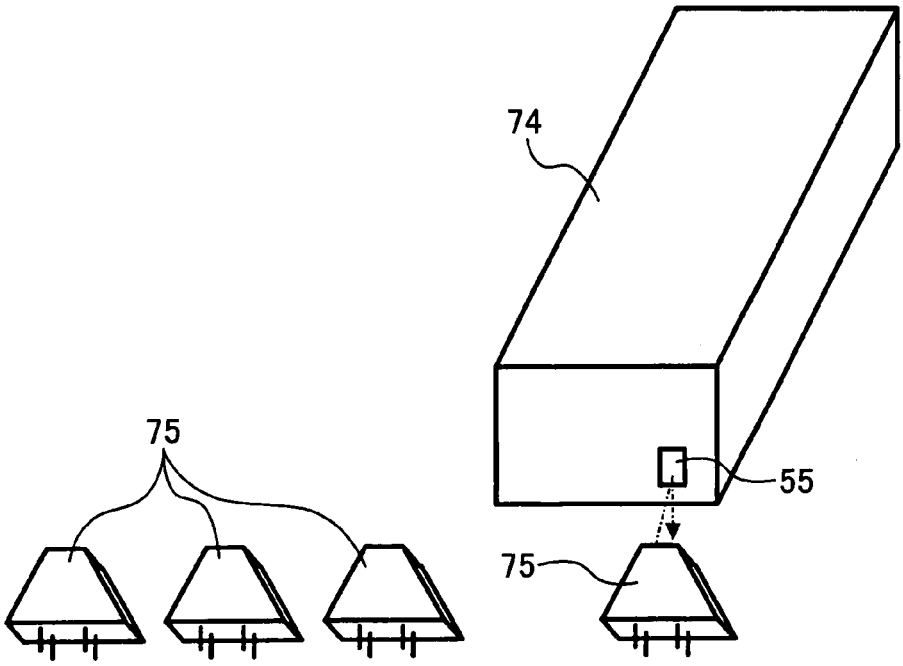
FIG. 14 is a view similar to FIG. 13, showing a plurality of sensing means.

Another specific configuration using the sensing means 75 is shown in FIG. 14. As shown, when a plurality of developing devices or a plurality of process cartridges 74 (only one is shown) are removably mounted on the apparatus body, a plurality of sensing means 75 are positioned at the respective station. In this configuration, the sensing means 75 automatically senses the color of toner stored in the developing device at the respective station each. This is successful to more surely determine the color of toner stored in each developing device mounted to the apparatus body for thereby obviating incorrect mounting.

Figure 15:
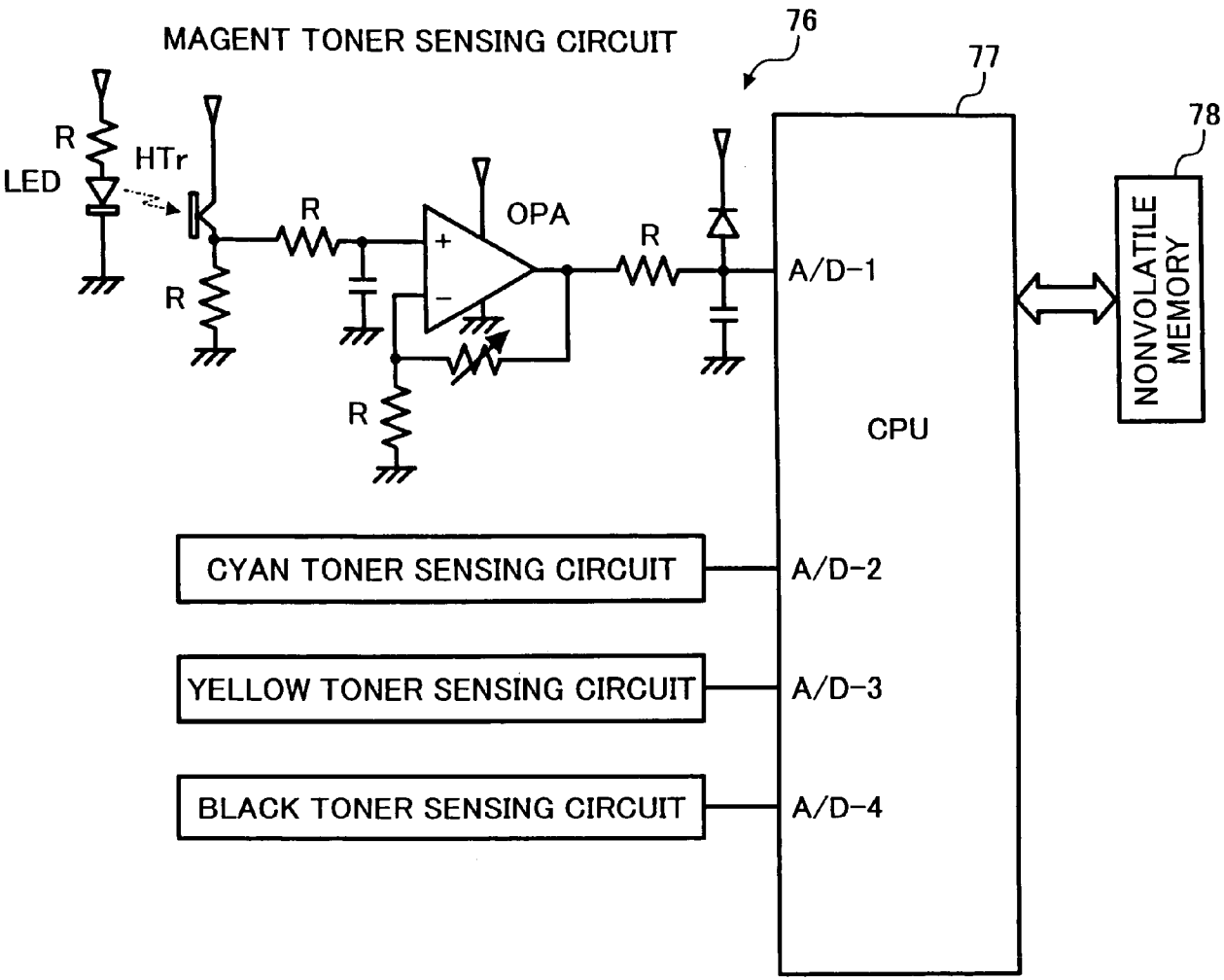
FIG. 15 is a schematic block diagram showing specific circuitry for comparing the outputs of the sensing means and color information stored in a nonvolatile memory.

FIG. 15 shows specific comparing means 76 for comparing the color sensed by the sensing means 75 and color information stored in storing means station by station. As shown, the comparing means 76 includes circuits each for sensing the color of particular one of magenta, cyan, yellow and black toners. Because such circuits are identical in configuration with each other, the following description will concentrate on the arrangement of the circuit responsive to the magenta toner.

As shown in FIG. 15, the sensing means 75 included in the circuit responsive to the magenta toner includes, e.g., an LED (Light Emitting Diode) and a phototransistor HTr. Light emitted from the LED is reflected by the toner and then incident on the phototransistor HTr with the result that a photocurrent, corresponding to the intensity of incident light, flows through the phototransistor HTr. The resulting voltage output from the phototransistor HTr is input to the non-inverting input terminal of an OPA (Operational Amplifier) via a resistor R. The OPA amplifies the input voltage and delivers the voltage thus amplified to the input terminal of an A/D-1 (A/D-2, A/D-3, and A/D-4 for cyan, yellow, and black, respectively) (Analog-to-Digital converter 1) included in a CPU (Central Processing Unit) 77.

A nonvolatile memory 78, also included in the CPU 77, stores a voltage corresponding to light to be reflected by magenta toner beforehand. The CPU 77 compares the voltage input to the A/D-1 and the voltage stored in the memory 78 in order to determine whether or not the developing device mounted to the station stores toner of expected color. If the color represented by the voltage input to the A/D-1 differs from the color stored in the memory 78, then the CPU 77 causes alerting means, not shown, to produce an alert tone or an alert message by way of example.

Figure 16:
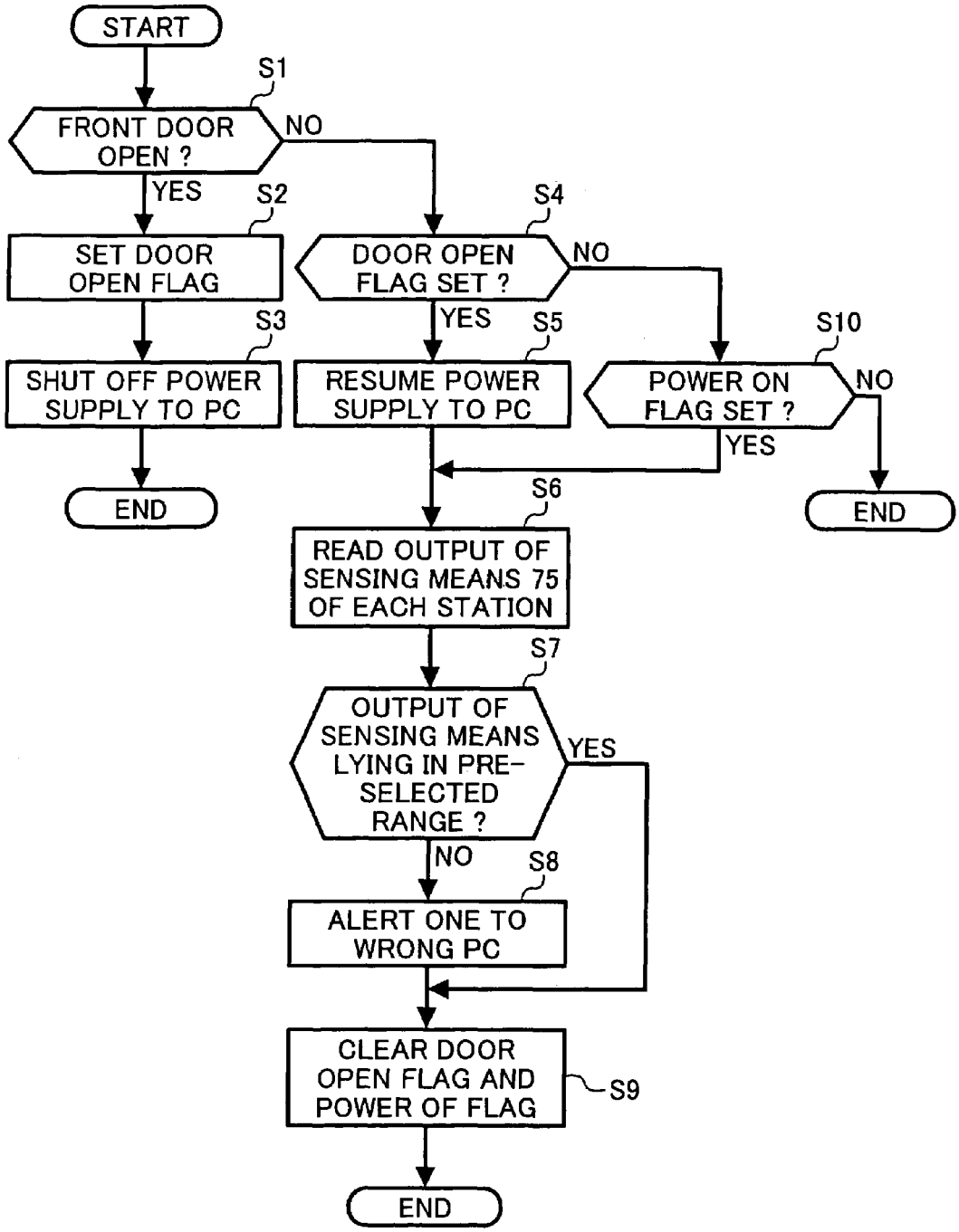
FIG. 16 is a flowchart demonstrating a specific control routine to be executed by the alternative embodiment that additionally includes alerting means.

FIG. 16 shows a specific control routine to be executed by the image forming apparatus including the alerting means stated above. Labeled PC in FIG. 16 is representative of the developing device or the process cartridge 74 to be removably mounted to the apparatus body. As shown, the CPU 77 first determines whether or not the front door of the apparatus body is open (step S1). If the front door is open (YES, step S1) the CPU 77 sets a door open flag (step S2) and then shuts off power supply to the PC 74 (step S3).

If the answer of the step S1 is negative (NO), meaning that the front door is not open, then the CPU 77 determines whether or not the door open flag has been set (step S4). If the answer of the step S4 is positive (YES), the CPU 77 resumes power supply to the PC 74 (step S5). Subsequently, the CPU 77 reads the outputs of the sensing means 75 located at the consecutive stations for avoiding incorrect mounting (step S6). The comparing means 76 compares the outputs of the sensing means 75 and the color information stored in the memory or storing means 78 station by station (step S7).

If the output of the sensing means 75 lies in a reselected range (YES, step S7), the CPU 77 clears the door open flag and a power ON flag, which will be described later, (step S9) and ends the control procedure. On the other hand, if the output of the sensing means 75 does not lie in the preselected range (NO, step S7), then the CPU 77 causes the alerting means to alert the operator of the printer to the mounting of a wrong PC (step S8), clears the door open flag and power ON flag (step S9) and ends the control procedure.

If the door open flag is not set (NO, step S4), then the CPU 77 determines whether or not the power ON flag is set (step S10). It is to be noted that the power ON flag is set by a power ON initializing routine, not shown, included in the illustrative embodiment. The CPU 77 executes the step S6 if the answer of the step S10 is YES or ends the control procedure if it is NO.

In summary, it will be seen that the present invention provides a developing device, a process cartridge and an image forming apparatus having various unprecedented advantages, as enumerated below.

(1) A window is formed in the wall of a developing device so as to allow one to see the inside of the developing device from the outside. It is therefore possible to see if the developing device is new or not with inexpensive means, i.e., without resorting to sophisticated, expensive means. In addition, by confirming the kind of toner stored in the developing device via the window before mounting the developing device to an apparatus body, the operator of the apparatus is prevented from mounting a wrong developing device.

(2) The above window is formed in the wall of each developing device to be mounted to an apparatus body, so that the operator can see the inside of each developing device from the outside. The operator can therefore surely distinguish a plurality of developing devices each storing toner of a particular color.

(3) The window is formed in the wall of a process cartridge including a developing device so as to allow one to see the inside of the developing device from the outside. It is therefore possible to see if the process cartridge is new or not with inexpensive means, i.e., without resorting to sophisticated, expensive means. In addition, by confirming the kind of toner stored in the process cartridge via the window before mounting the process cartridge to an apparatus body, the operator of the apparatus is prevented from mounting a wrong process cartridge.

(4) The window is formed in the wall of each process cartridge to be mounted to the apparatus body, so that the operator can see the inside of each process cartridge from the outside. The operator can therefore surely distinguish a plurality of process cartridges each storing toner of a particular color.

(5) The operator can see the inside of the developing device via the window from the outside after mounting the developing device or the process cartridge to the apparatus body. It is therefore possible to easily see the inside of the developing device or that of the process cartridge without removing it from the apparatus body.

(6) The colors of toners stored in a plurality of developing devices set at four consecutive stations can be seen via the windows from the outside, so that the operator is surely prevented from confusing the developing devices or the process cartridges.

(7) By comparing the color of toner stored in a developing device with the color of a color display member, the operator is more surely prevented from incorrectly mounting the developing device or the process cartridge.

(8) Sensing means automatically senses the color of toner stored in the developing device when the developing device or the process cartridge is set on the apparatus body. Therefore, in the case where a plurality of developing devices or a plurality of process cartridges are mounted to the apparatus body, sensing means positioned at the consecutive stations each sense the color of toner store in the respective developing device. This allows the colors of toners stored in the developing devices to be more positively sensed for thereby obviating erroneous mounting.

(9) Comparing means compares a color represented by the output of the sensing means and color information stored in storing means, which are converted to electric information. It is therefore possible to surely, easily determine whether or not a developing device or a process cartridge is mounted to a correct station.

(10) If the color represented by the output of the sensing means and the color of the station do not compare equal, as determined by the comparing means, then alerting means alerts the operator to incorrect mounting. This allows the operator, which may be the user of a service person, to easily see the incorrect mounting of a developing device or a process cartridge.

Various modifications will become possible for those skilled in the art after receiving the teachings of the present disclosure without departing from the scope thereof.

What is claimed is:

1. A developing device comprising:

a developing roller configured to roll about an axis of rotation, wherein the developing device stores, in an unmounted state, only a carrier, which forms part of a two-ingredient type developer, the developing device is configured to be replenished with a toner, which forms the other part of said two-ingredient type developer, after being removably mounted to a body of an image forming apparatus for developing a latent image formed on an image carrier with said toner to thereby produce a corresponding toner image, a window is disposed in a portion of said developing device that allows a user to see an inside of said developing device from an outside, and the window faces a direction parallel to the axis.

2. The developing device as claimed in claim 1, wherein said developing device comprises a plurality of developing devices removably mounted to the body of the image forming apparatus and each configured to be replenished with the toner of a particular kind.

3. An image forming apparatus comprising:

a sensor configured to sense a color of toner; and a developing device storing, in an unmounted state, only a carrier, which forms part of a two-ingredient type developer, the developing device configured to be replenished with a toner, which forms the other part of said two-ingredient type developer, after being removably mounted to a body of an image forming apparatus for developing a latent image formed on an image carrier with said toner to thereby produce a corresponding toner image, a window disposed in a portion of said developing device that allows a user to see an inside of said developing device from an outside, wherein the sensor is configured to directly sense the color of the toner via the window.

4. The apparatus as claimed in claim 3, wherein the portion faces upward while the developing device is mounted to the body of the image forming apparatus.

5. The apparatus of claim 3, wherein the window faces a direction parallel to an axis of rotation of a developing roller disposed inside the developing device.

6. A process cartridge comprising:

a developing roller configured to roll about an axis of rotation; and at least a developing device storing, in an unmounted state, only a carrier, which forms part of a two-ingredient type developer, wherein the developing device is configured to be replenished with a toner, which forms the other part of said two-ingredient type developer, after being removably mounted to a body of an image forming apparatus for developing a latent image formed on an image carrier with said toner to thereby produce a corresponding toner image;

a window is disposed in a portion of said developing device that allows a user to see an inside of said developing device from an outside, and the window faces a direction parallel to the axis.

7. The process cartridge as claimed in claim 6, wherein said process cartridge comprises a plurality of process cartridges removably mounted to the body of the image forming apparatus and each configured to be replenished with the toner of a particular kind.

8. An image forming apparatus comprising:

a sensor configured to sense a color of toner; and a process cartridge including at least a developing device storing, in an unmounted state, only a carrier, which forms part of a two-ingredient type developer, and configured to be replenished with a toner, which forms the other part of said two-ingredient type developer, after being removably mounted to a body of an image forming apparatus for developing a latent image formed on an image carrier with said toner to thereby produce a corresponding toner image, wherein a window disposed in a portion of said process cartridge that allows a user to see an inside of said developing device from an outside, and the sensor is configured to directly sense the color of the toner via the window.

9. The apparatus as claimed in claim 8, wherein the portion faces upward while the developing device is mounted to the body of the image forming apparatus.

10. The apparatus of claim 8, wherein the window faces a direction parallel to an axis of rotation of a developing roller disposed inside the developing device.

11. An image forming apparatus comprising:

a sensor configured to sense a color of toner; and one of, a developing device configured to store, in an unmounted state, only a carrier, which forms part of a two-ingredient type developer, and further configured to be replenished with a toner, which forms the other part of said two-ingredient type developer, after being removably mounted to a body of an image forming apparatus for developing a latent image formed on an image carrier with said toner to thereby produce a corresponding toner image; and a process cartridge including said developing device, wherein a window is formed in said a portion of said developing device or said process cartridge that allows a user to see an inside of said developing device from an outside without removing said developing device or said process cartridge from said body, and the sensor is configured to directly sense the color of the toner via the window.

12. The apparatus as claimed in claim 11, wherein said developing device or said process cartridge comprises four developing devices or four process cartridges, respectively, respectively mounted to four stations of the body of said apparatus for forming a full-color image on the image carrier.

13. The apparatus as claimed in claim 12, wherein a color display member displaying a particular color is positioned at each of the four stations.

14. The apparatus as claimed in claim 12, wherein one sensor is positioned at each of the four stations and configured to sense a color of the toner replenished to the developing device.

15. The apparatus as claimed in claim 14, wherein comparing means compares a color represented by an output of said sensing means and color information stored in storing means station by station.

16. The apparatus as claimed in claim 15, wherein if the color represented by the output of said sensing means and the color information stored in said storing means are different from each other, alerting means produces an alert.

17. The apparatus as claimed in claim 11, wherein the portion faces upward while the developing device is mounted to the body of the image forming apparatus.

18. The apparatus of claim 11, wherein the window faces a direction parallel to an axis of rotation of a developing roller disposed inside the developing device.

* * * * *